US007325946B2

(12) United States Patent
Tyson

(10) Patent No.: US 7,325,946 B2
(45) Date of Patent: Feb. 5, 2008

(54) FLUORESCENT LAMP FIXTURE AND HEATER

(75) Inventor: Glenn M. Tyson, La Crescenta, CA (US)

(73) Assignee: Acuity Brands, Inc., Atlanta, GA (US)

( * ) Notice: Subject to any disclaimer, the term of this patent is extended or adjusted under 35 U.S.C. 154(b) by 290 days.

(21) Appl. No.: 11/104,016

(22) Filed: Apr. 11, 2005

(65) Prior Publication Data

US 2006/0227552 A1 Oct. 12, 2006

(51) Int. Cl.
*F21V 23/02* (2006.01)

(52) U.S. Cl. ..... 362/260; 313/15

(58) Field of Classification Search ..... 362/260, 362/293, 218, 294; 313/14, 15, 37, 44, 112, 313/341, 591

See application file for complete search history.

(56) References Cited

U.S. PATENT DOCUMENTS 2,010,852 A * 8/1935 Druyvesteyn ..... 313/44
3,779,640 A * 12/1973 Kidd ..... 313/15
5,079,681 A * 1/1992 Baba et al. ..... 362/260
6,352,356 B1 * 3/2002 Noll ..... 362/260

* cited by examiner

*Primary Examiner*—Stephen F. Husar
(74) *Attorney, Agent, or Firm*—Connolly Bove Lodge & Hutz LLP

(57) ABSTRACT

A lamp fixture includes a housing with a high voltage end lamp socket therein. A fluorescent lamp extends from the socket. A heater is at the fluorescent lamp at the high voltage end lamp socket and is adjacent to. The heater includes a plate radiator which is attached to the outside of the light reflector and a thermostat. The thermostat is hooked to the line voltage to the fixture. A substantially clear heat reflector extends partially around the fluorescent lamp and, with the heater, substantially encloses circumferentially the fluorescent lamp at the high voltage end lamp socket. The reflector is pivotally mounted relative to the fluorescent lamp to allow retraction of the heat reflector for placement of the fluorescent lamp. A light reflector extends partially around the fluorescent lamp.

28 Claims, 3 Drawing Sheets

FLUORESCENT LAMP FIXTURE AND HEATER

BACKGROUND OF THE INVENTION

The field of the present invention is fixtures and equipment for fluorescent lamps.

Fluorescent lighting has long provided cost effective, efficient and low heat artificial light sources finding utility, inter alia, for outdoor signage. However, the brightness and striking requirements are affected by colder environments. The striking of such lamps in cold conditions is easily accommodated through an increase in the capability of the ballast. Once struck, brightness continues to be an issue when the lamp is cold.

SUMMARY OF THE INVENTION

The present invention is directed to fixtures for fluorescent lamps and a heater associated therewith.

In a first separate aspect of the present invention, a fixture for a fluorescent lamp includes a high voltage end lamp socket and a heater at the high voltage end lamp socket to heat the end of a fluorescent lamp.

In a second separate aspect of the present invention, a fixture including the high voltage end lamp socket and a heater adjacent that socket to heat the adjacent end of a fluorescent lamp also includes a heat reflector arranged to extend partially around a fluorescent lamp at the heater. The heater and the heat reflector may substantially circumferentially surround a fluorescent lamp adjacent the socket. The heat reflector may be clear to the spectrum of light from the fluorescent lamp and pivotally mounted to allow replacement of the lamp.

In a third separate aspect of the present invention, a lamp fixture includes a high voltage end lamp socket, a fluorescent lamp and a heater adjacent the high voltage lamp socket and adjacent the fluorescent lamp. The heater includes a plate radiator extending circumferentially partially about the fluorescent lamp.

In a fourth separate aspect of the present invention, any of the foregoing separate aspects are contemplated to be employed in combination to further advantage.

Accordingly, it is an object of the present invention to provide an improved fixture for a fluorescent light which provides enhanced brightness in cold environments. Other and further objects and advantages will become apparent hereafter.

DETAILED DESCRIPTION OF THE PREFERRED EMBODIMENT

Figure 1:
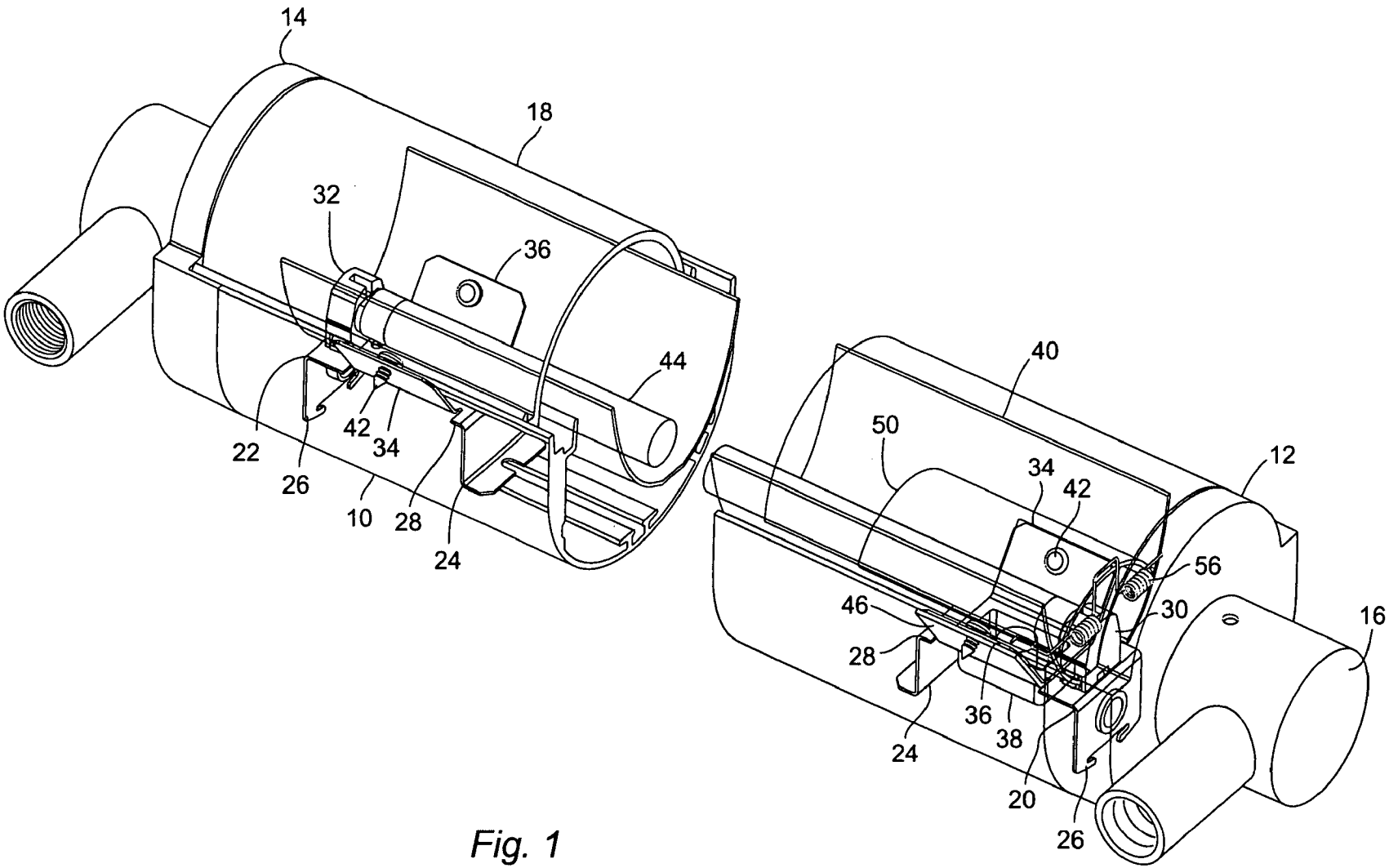
FIG. 1 is a perspective view of a fixture for a fluorescent lamp with the components artificially shown in transparency for greater understanding.
Figure 2:
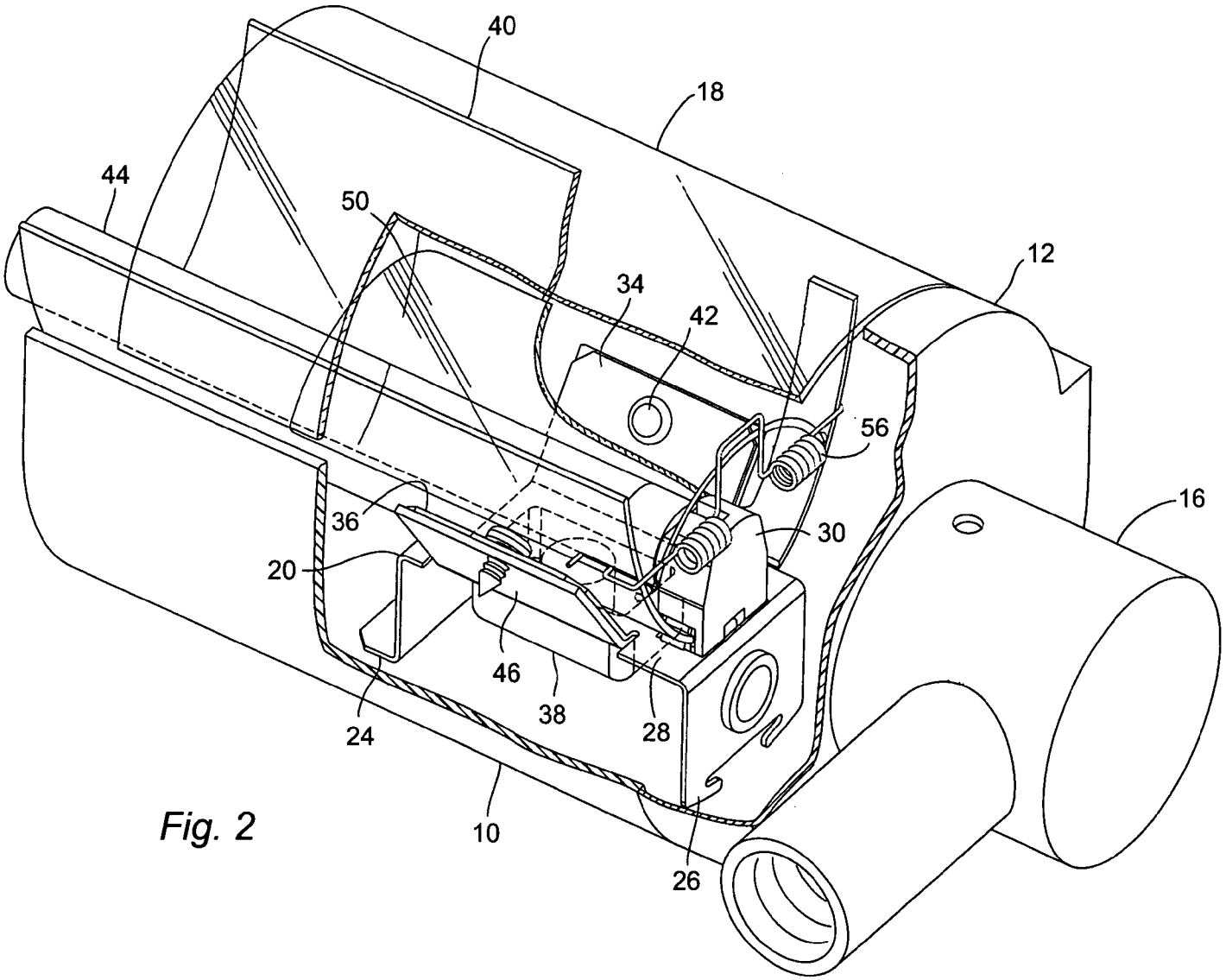
FIG. 2 is a perspective view of the high voltage end of the fixture.

Turning in detail to the Figures, FIG. 1 illustrates a lamp fixture including a housing 10, housing end caps 12, 14 and an electrical access cap 16. A transparent lens 18 closes the housing 10.

Within the housing 10, two socket brackets 20, 22 are positioned at opposing ends. Each bracket 20, 22 includes conventional anchoring feet 24, 26 and a platform 28 upon which are mounted opposed sockets 30, 32, respectively. Mounting wings 34, 36 diverge from the platform 28.

The opposed sockets 30, 32 provide a high voltage end lamp socket 30 and a low voltage end lamp socket 32. The opposed sockets 30, 32 define a fluorescent lamp location extending therebetween. Alternatively, if fluorescent lamps which mate with a single socket are contemplated, the fluorescent lamp location simply extends axially from a single socket 30 for the length of a contemplated lamp.

A light reflector 40 is mounted to the platforms 28 of the socket brackets 20, 22. The light reflector extends partially around the fluorescent lamp location with a curvature dictated by the desired light distribution of the lamp. The light reflector also extends substantially the length of the lamp location and faces toward the lens 18 in a conventional manner. In this embodiment, the light reflector 40 is of aluminum with a light reflecting surface in the elongate concavity. The light reflector 40 is retained at either end by fasteners 42 engaging the four mounting wings 34, 36. A fluorescent lamp 44 of the type having four pins, two at each end, is shown extending between the sockets 30, 32 within the light reflector 40 in the appropriate lamp location.

A heater is employed at the end of the fluorescent lamp 44 at the high voltage end lamp socket 30. The heater includes a plate radiator 46 and a thermostat 48. The thermostat 48 is located in a cavity 38 attached to the plate radiator 46 and the plate radiator 46 is found on the underside of the platform 28 and mounting wings 34, 36 of the socket bracket 20. The thermostat 48 is connected to line voltage as is the ballast (not shown) for the fluorescent lamp 44. The thermostat 48 is set in this embodiment to regulate the temperature of the heater output around the high voltage end of the fluorescent lamp 44. The intention is to have the end of the fluorescent lamp 44 be at 45° C. It may be empirically determined that the thermostat 48 should be set slightly above that temperature to effect that result. The thermostat 48 is electrically connected with the plate radiator 46. Therefore, the heater will turn on and off coincident with the ballast.

As the light reflector 40 and the mounting wings 34, 36 are traditionally metallic, heat is quickly and efficiently transferred to the elongate concavity of the light reflector 40 adjacent the high voltage end lamp socket 30 without the heater being in contact with the fluorescent lamp. Where plastic components are employed, the plate radiator 46 may be positioned either between the mounting wings 34, 36 and the light reflector 40 or in the elongate concavity within the light reflector 40 so as to efficiently transfer heat to the high voltage end of the fluorescent lamp 44. In extreme cases, the heater may be in contact with the tube of the fluorescent lamp 44. It is desirable that the heater raise the temperature of the high voltage end of the fluorescent lamp 44 to within an operating range, albeit not fully to 45° C., within a short period of time of one to two minutes. Consequently, more or less power is anticipated based on the anticipated environmental conditions. As the plate radiator 46 may be affixed to the mounting wings 34, 36, located within the elongate concavity of the light reflector 40 or even in contact with the tube of the fluorescent lamp 44, the heater extends circumferentially partially about the fluorescent lamp location at the fluorescent lamp 44 at the high voltage end lamp socket 30.

To increase the effectiveness of the heater, a heat reflector 50 may be employed. The heat reflector 50 is located within the elongate concavity of the light reflector 40 adjacent the high voltage end lamp socket 30 and positioned in opposition across the fluorescent lamp from the heater. The heat reflector 50 may also extend over the socket 30 as well as further into the elongate concavity of the light reflector 40 beyond the extent of the plate radiator 46 to augment heat retention.

Figure 3:
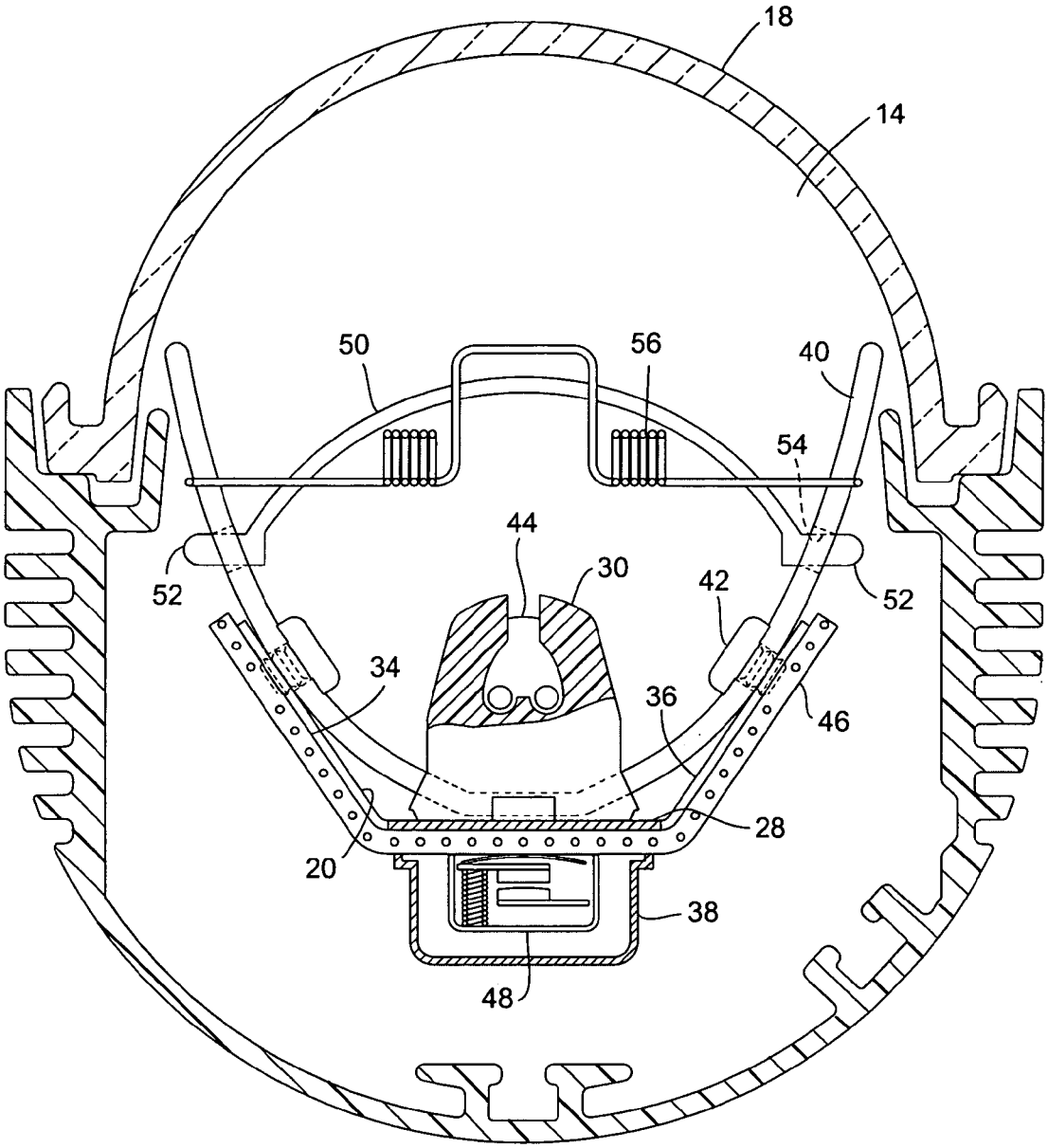
FIG. 3 is a cross-sectional view looking at the high voltage end of the fixture.

The heat reflector is shown to be a segment of a cylinder and from the view of FIG. 3 is shown to extend circumferentially partially about the fluorescent lamp. As such, the plate radiator 46 and the heat reflector 50 substantially circumferentially enclose the fluorescent lamp 44 at the high voltage end lamp socket 30.

The heat reflector 50 is preferably substantially clear to the spectrum of light from the fluorescent lamp. It is also advantageous if that material is opaque to the infrared spectrum. A clear thermoplastic having these properties is contemplated.

The heat reflector 50 is pivotally mounted by integrally formed pins extending outwardly from the body of the reflector at one end thereof. The pins 52 extend into holes 54 conveniently in the light reflector 40. This allows retraction of the heat reflector 50 for placement of a fluorescent lamp 44 in the socket 30. A retainer 56 resistively holds the heat reflector 50 against the elongate concavity of the light reflector 40 as illustrated in the Figures. The retainer 56 is shown to be a coil spring attached at either end to the light reflector 40 and having a formed tab to engage the edge of the heat reflector 50. Other configurations of the retainer 56 may be employed including a leaf spring or other spring mechanism or a retaining detent or latch, with or without a biased return of the heat reflector 50 to the position against the light reflector 40.

Accordingly, a heating system to increase brightness of fluorescent lamps in cold environments has been disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A fixture for a fluorescent lamp, comprising a high voltage end lamp socket defining a fluorescent lamp location;

a heater at the end of the fluorescent lamp location at the high voltage end lamp socket;

a heat reflector extending at least partially around the fluorescent lamp location at the heater.

2. The fixture of claim 1, the heater including a plate radiator.

3. The fixture of claim 1, the heater including a thermostat.

4. The fixture of claim 1, the heat reflector and the plate radiator together substantially circumferentially surrounding the fluorescent lamp location at the high voltage end lamp socket.

5. The fixture of claim 4, the heat reflector being a segment of a cylinder.

6. The fixture of claim 4, the heater extending circumferentially partially about the fluorescent lamp location.

7. The fixture of claim 4, the heat reflector being substantially clear to the spectrum of light from a fluorescent lamp.

8. The fixture of claim 4, the heat reflector extending over the high voltage end lamp socket.

9. The fixture of claim 1, the heat reflector being pivotally mounted relative to the fluorescent lamp location to allow retraction of the heat reflector for placement of a fluorescent lamp in the fluorescent lamp location.

10. The fixture of claim 1, further comprising a light reflector extending partially around and at least substantially the length of the fluorescent lamp location.

11. The fixture of claim 10, the heater including a plate radiator fixed against the light reflector.

12. The fixture of claim 10 further comprising a heat reflector extending partially around the fluorescent lamp location at the heater being pivotally mounted relative to the fluorescent lamp location, the heat reflector and the light reflector circumferentially surrounding the fluorescent lamp location adjacent the heater.

13. The fixture of claim 12, the heat reflector including a retainer resistively holding the heat reflector against the light reflector.

14. A lamp fixture comprising a high voltage end lamp socket;

a fluorescent lamp extending from the high voltage end lamp socket;

a heater at the end of the fluorescent lamp at the high voltage end lamp socket, the heater including a plate radiator extending circumferentially partially about the fluorescent lamp and a thermostat;

a heat reflector extending at least partially around the fluorescent lamp at the heater.

15. The fixture of claim 14, the heat reflector and the plate radiator together substantially circumferentially surrounding the end of the fluorescent lamp at the high voltage end lamp socket.

16. The fixture of claim 15, the heat reflector being pivotally mounted relative to the fluorescent lamp to allow retraction of the heat reflector.

17. The fixture of claim 14 further comprising a light reflector extending partially around and at least substantially the length of the fluorescent lamp.

18. The fixture of claim 17, the heater being fixed against the light reflector.

19. The fixture of claim 14, the heater not touching the fluorescent lamp.

20. A lamp fixture comprising a high voltage end lamp socket;

a fluorescent lamp extending from the at least one lamp socket;

a heater at the end of the fluorescent lamp at the high voltage end lamp socket;

a heat reflector extending at least partially around the fluorescent lamp at the heater, the heat reflector and the heater together substantially circumferentially surrounding the end of the fluorescent lamp at the high voltage end lamp socket.

21. The fixture of claim 20, the heat reflector being a segment of a cylinder.

22. The fixture of claim 20, the heater extending circumferentially partially about the fluorescent lamp.

23. The fixture of claim 20, the heat reflector being substantially clear to the spectrum of light from the fluorescent lamp.

24. The fixture of claim 20, the heat reflector extending over the high voltage end lamp socket.

25. The fixture of claim 20, the heat reflector being pivotally mounted relative to the fluorescent lamp to allow retraction of the heat reflector for placement of the fluorescent lamp.

26. The fixture of claim 20, further comprising a light reflector extending partially around and at least substantially the length of the fluorescent lamp.

27. The fixture of claim 26, the heater including a plate radiator fixed against the light reflector.

28. The fixture of claim 26, the heat reflector including a retainer resistively holding the heat reflector against the light reflector.

* * * * *